US009826853B1

(12) United States Patent
Fonseca et al.

(10) Patent No.: US 9,826,853 B1
(45) Date of Patent: Nov. 28, 2017

(54) MAILBOX SYSTEM WITH ILLUMINATED ADDRESS INFORMATION

(71) Applicants: Efrain Fonseca, Kissimmee, FL (US); Bernice Fonseca, Kissimmee, FL (US)

(72) Inventors: Efrain Fonseca, Kissimmee, FL (US); Bernice Fonseca, Kissimmee, FL (US)

( * ) Notice: Subject to any disclaimer, the term of this patent is extended or adjusted under 35 U.S.C. 154(b) by 0 days.

(21) Appl. No.: 15/293,125

(22) Filed: Oct. 13, 2016

(51) Int. Cl.
*A47G 29/12* (2006.01)

(52) U.S. Cl.
CPC ..... *A47G 29/1212* (2013.01); *A47G 29/1216* (2013.01)

(58) Field of Classification Search
CPC ..... A47G 29/1212; A47G 29/1216; A47G 2029/1226; A47G 29/122; A47G 29/30; G09F 23/00; G09F 2013/0417; G09F 2013/222
USPC ..... 232/17, 38, 39; 40/566, 606.06
See application file for complete search history.

(56) References Cited

U.S. PATENT DOCUMENTS 6,708,876 B1 * 3/2004 Shirah ..... A47G 29/1209 232/38
6,719,193 B2 * 4/2004 Katulka ..... G09F 13/08 232/34
6,964,366 B2 * 11/2005 Peng ..... A47G 29/1209 232/38
7,293,696 B2 * 11/2007 Laborde ..... A47G 29/122 232/38
7,350,692 B2 * 4/2008 Bushee ..... A47G 29/1212 232/17
7,578,085 B1 * 8/2009 Chao ..... G09F 13/04 232/17
8,182,113 B2 * 5/2012 Sharpe ..... A47G 29/1209 232/45
8,819,968 B1 * 9/2014 Van Beek ..... G09F 13/22 40/544
2006/0118609 A1 * 6/2006 Iannello ..... A47G 29/1209 232/38
2006/0150453 A1 * 7/2006 Martin ..... G09F 13/22 40/544
2008/0257947 A1 * 10/2008 Guo ..... A01K 1/033 232/38
2015/0001283 A1 * 1/2015 Morris ..... A47G 29/122 232/17
2015/0108209 A1 * 4/2015 Cho ..... A47G 29/1212 232/34

* cited by examiner

*Primary Examiner* — William Miller
(74) *Attorney, Agent, or Firm* — Jason T. Daniel, Esq.; Daniel Law Offices, P.A.

(57) ABSTRACT

A mailbox system includes a mailbox body for receiving and storing mail items. One or more receiver units are disposed along an outside facing surface of the mailbox body and function to receive at least one address indicator having a plurality of lighted elements along a front facing surface thereof. An internal controller having a power unit is positioned within the mailbox body. The power unit includes at least one battery and at least one solar cell for supplying the necessary electrical information to the receiver unit and the address indicators. Physical markings are disposed along the address indicator and form address information. When activated, the plurality of lighted elements display address information.

10 Claims, 7 Drawing Sheets

MAILBOX SYSTEM WITH ILLUMINATED ADDRESS INFORMATION

TECHNICAL FIELD

The present invention relates generally to mailboxes, and more particularly to a mailbox having illuminated address information.

BACKGROUND

The statements in this section merely provide background information related to the present disclosure and may not constitute prior art.

Mailboxes for single family homes are typically free-standing devices having an elongated pedestal upon which a container is mounted for receiving and storing mail. Each of these mailboxes are typically adorned with painted numbers which represent the address of the home to which it belongs. Such a feature is advantageous, as it allows guests and visitors to easily identify the correct property to which they are traveling.

Although these numbers work well in daylight to provide the address of the home, they are often difficult to see at night. Moreover, it is not uncommon for the address information to dramatically fade over time, thus making it virtually impossible to make out the address listed on the mailbox at night.

The present invention, directed to a mailbox with illuminated address information differs from the conventional art in a number of aspects. The manner by which will become more apparent in the description which follows, particularly when read in conjunction with the accompanying drawings.

SUMMARY OF THE INVENTION

The present invention is directed to a mailbox system. One embodiment of the present invention can include a mailbox body that is capable of receiving and storing mail items. The mailbox body can include one or more receiver units along an outside facing surface. Each of the one or more receiver units can act to receive at least one address indicator, having a plurality of lighted elements along a front facing surface thereof.

In another embodiment, the mailbox system can also include an internal controller having a power unit. The power unit can include at least one battery and at least one solar cell for supplying the necessary electrical information to the receiver unit and the address indicators. When activated, the plurality of lighted elements can display any type of address information that is selected by a user.

In yet another embodiment, the mailbox system can also include physical markings that encompass the plurality of lighted elements. The physical markings can display the same address information.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
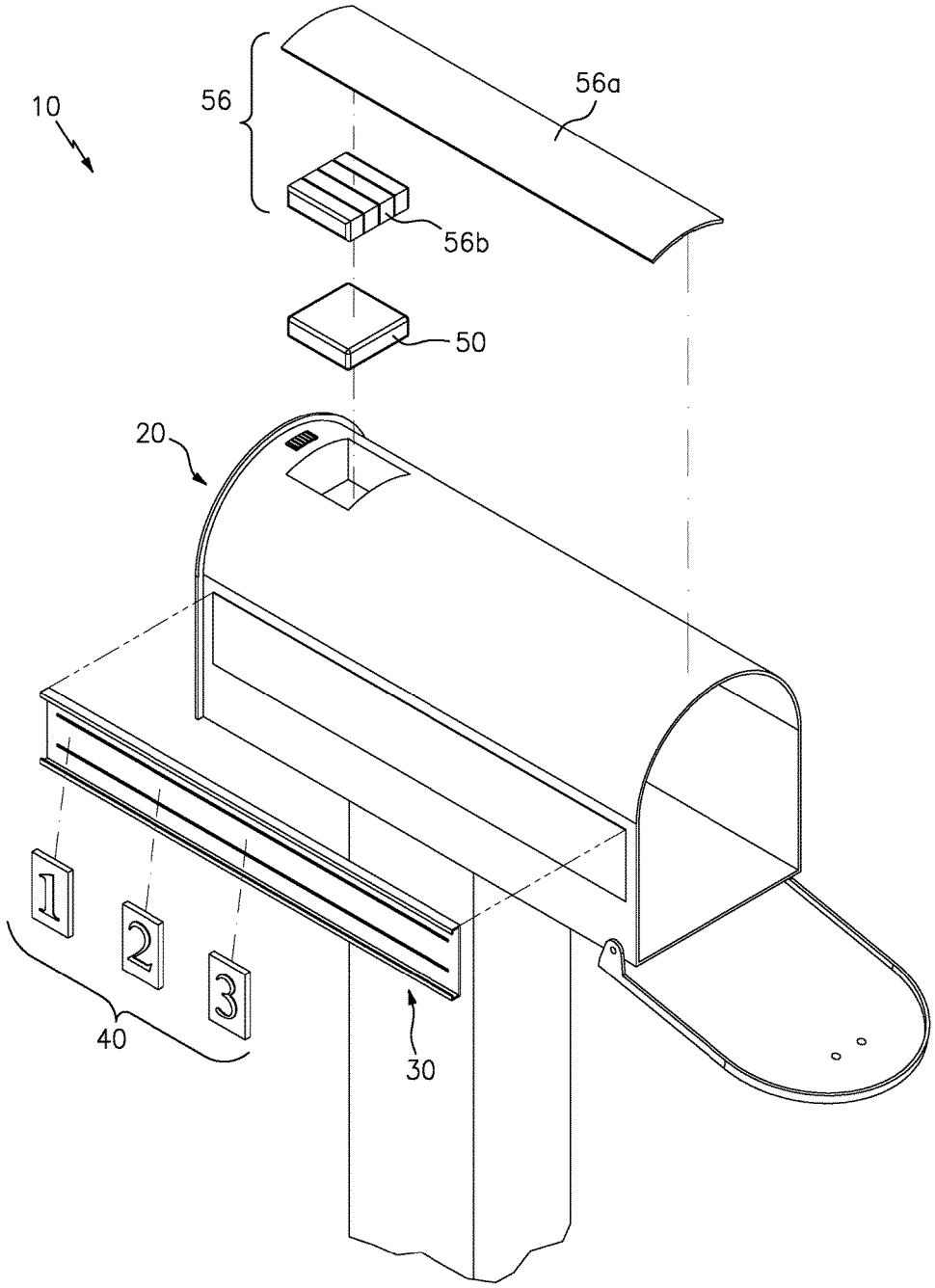
FIG. 1 is an exploded parts view of the mailbox system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and/or size of a component that is identical to, or substantially identical to the shape and/or size of another identified component.

As described herein, the term "removably secured" and derivatives thereof shall be used to describe a situation wherein two or more objects are joined together in a non-permanent manner so as to allow the same objects to be repeatedly joined and separated. This can be accomplished through the use of the below described upper and lower channels, and/or any number of commercially available connectors such as opposing strips of hook and loop material (i.e. Velcro®), magnetic elements, and compression fittings such as hooks, snaps and buttons, for example. Moreover, the term "permanently secured" shall be used to describe a situation wherein two or more objects are joined together in a manner so as to prevent the same objects from being separated. Several nonlimiting examples include various adhesives such as glue or resin, welds and/or hardware such as nuts and bolts, for example.

FIGS. 1-6 illustrate various embodiments of a mailbox with illuminated address information 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 is an exploded parts view of the system components. As shown, the mailbox system 10 can include, essentially, a mailbox body 20, one or more receiver units 30, a plurality of address indicators 40, an internal controller 50 and a power unit 56.

Figure 2:
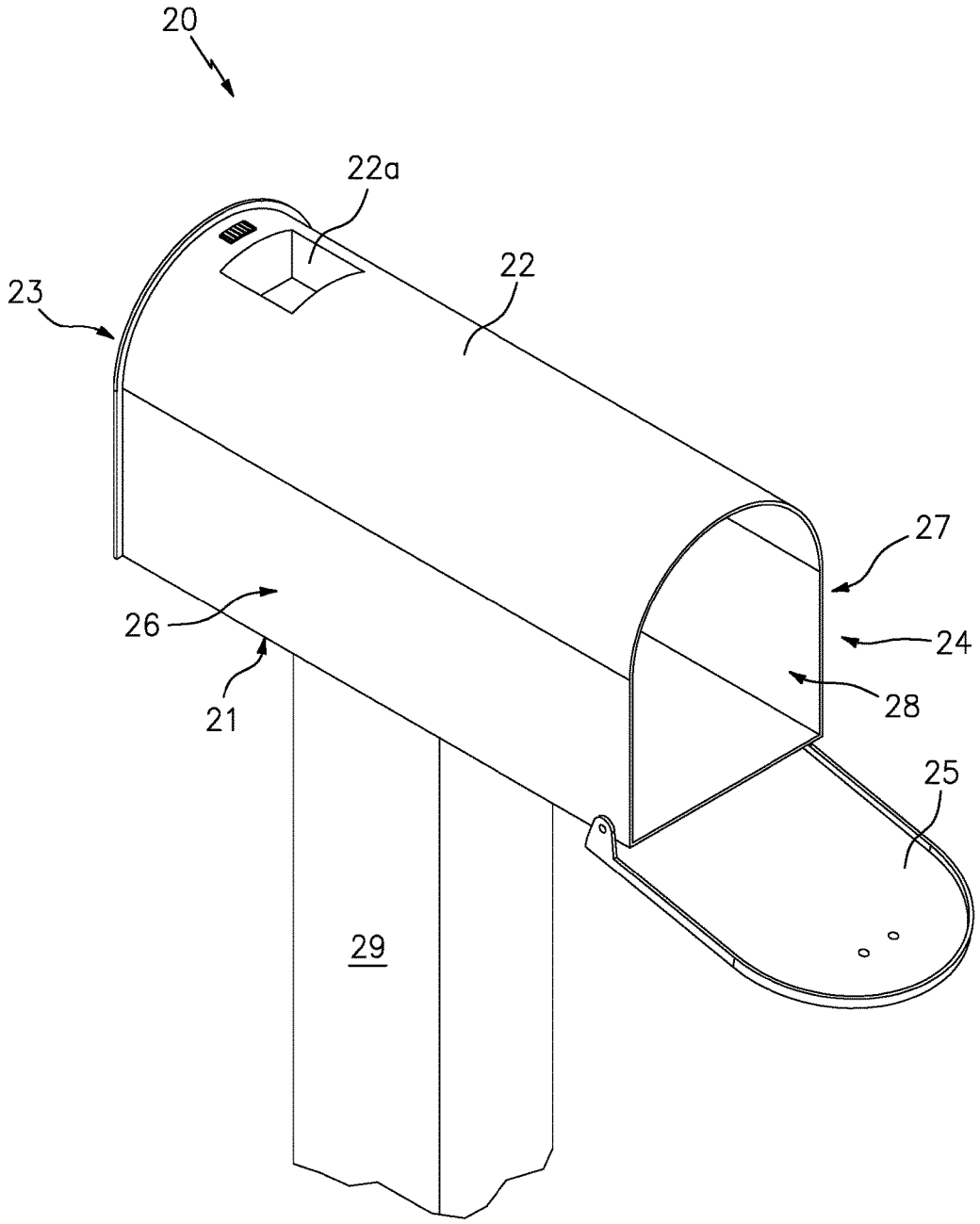
FIG. 2 is a perspective view of the mailbox body of the mailbox system, in accordance with one embodiment of the invention.

As shown in FIG. 2, the mailbox body 20 can include an elongated member having a bottom end 21, a top end 22, a capped back end 23, an open front end 24, a door 25, and a pair of opposing sides 26 and 27 that define a generally hollow interior space 28. The mailbox can be constructed from any number of different materials that are suitable for prolonged exposure to adverse weather conditions such as plastic and metal, for example, and can include an unlimited number of different shapes and sizes.

As shown, the mailbox can be mounted onto a pedestal 29 which may also include a horizontal arm (not illustrated). In the preferred embodiment, a recessed area 22*a* can be formed along the top end of the mailbox 22, so as to receive the below described controller 50.

Figure 3:
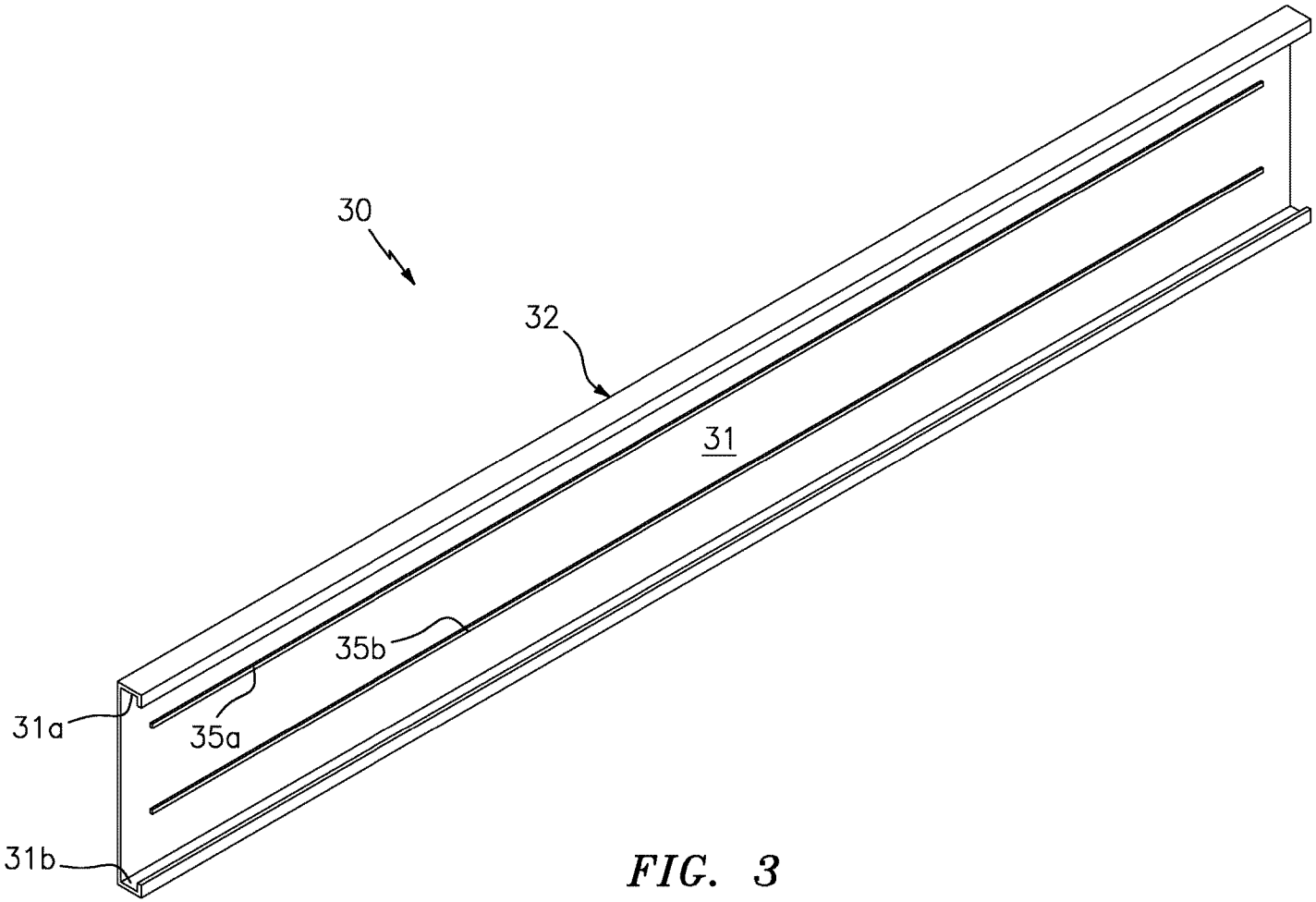
FIG. 3 is a perspective view of the address receiver of the mailbox system, in accordance with one embodiment of the invention.

FIG. 3 illustrates one embodiment of a receiver unit 30 that includes an elongated main body having a front facing surface 31, and a rear facing surface 32. In the preferred embodiment, a pair of elongated, generally U-shaped channels 31*a* and 31*b* can extend along the top and bottom ends of the front facing surface (i.e., upper and lower channels). The channels can function to receive any number of address indicators 40 which can be slid along the length of the receiver unit body (e.g., slidingly receive).

As shown, the receiver unit 30 can also include a pair of metallic supply contacts 35*a* and 35*b* which can run along the length of the front surface 31. Each of the contacts can be in communication with the battery 56*b* of the below described power unit, so as to receive and provide positive and negative direct current (dc) electricity, respectively, to the complementary contacts of the address indicators.

As described herein, the receiver unit can preferably be constructed from a durable and non-electrically conductive material such as plastic, for example, and can include any number of different shapes and sizes. The rear facing surface 32 of the receiver unit can be connected to the mailbox 20 utilizing any number of different connectors such as various adhesives and/or hardware such as nuts and bolts, for example.

Figure 4B:
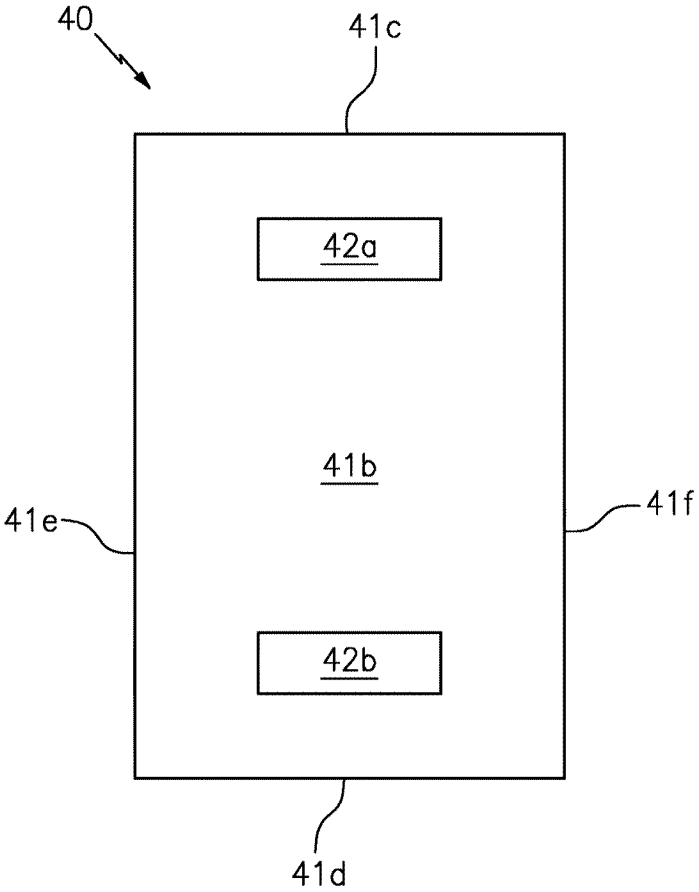
FIG. 4B is a back side view of an address indicator of the mailbox system, in accordance with one embodiment of the invention.
Figure 4A:
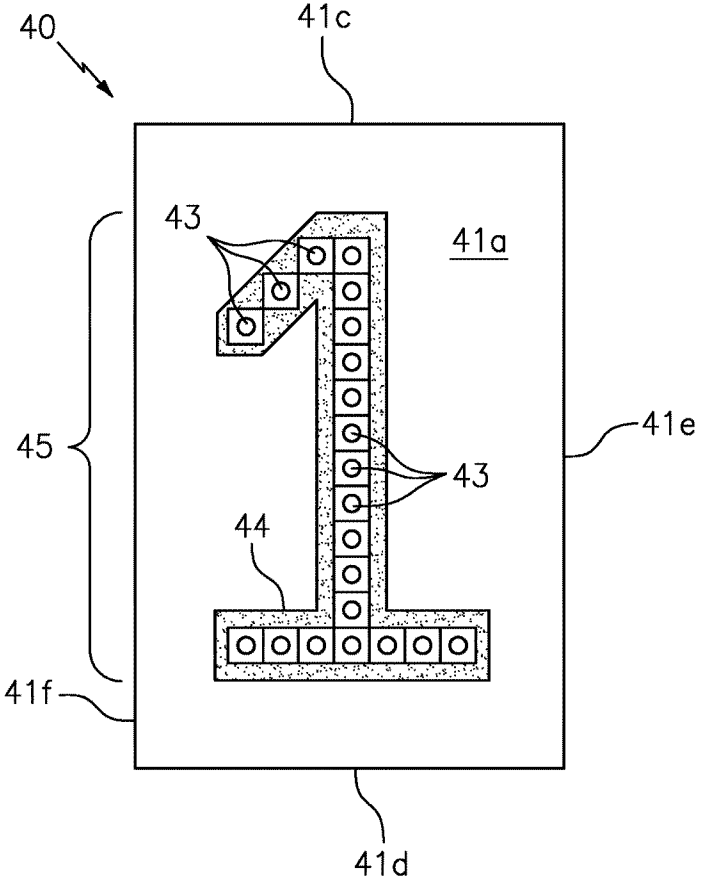
FIG. 4A is a front side view of an address indicator of the mailbox system, in accordance with one embodiment of the invention.

FIGS. 4A and 4B illustrate one exemplary embodiment of an address indicator 40 that includes a main body having a front surface 41*a*, a rear surface 41*b*, a top end 41*c*, a bottom end 41*d*, and a pair of opposing sides 41*e* and 41*f*. As described herein, each of the address indicators 40 can include any number of different shapes and sizes, and can be constructed from any number of different materials, such as plastic, for example.

In one embodiment, a pair of metallic receiver contacts 42*a* and 42*b* can be positioned along the rear surface 41*b*, and can be positioned so as to make contact with the supply contacts 35*a* and 35*b*, respectively, when the address indicator 40 is secured along the receiver unit 30.

As shown, a plurality of lighted elements 43 and/or physical markings 44 can be arranged along the address indicator 40 so as to form any type of address information 45. In the preferred embodiment, each of the lighting elements can include or comprise one or more light emitting diodes (LED), for example, that can be connected to the receiver contacts 42*a* and 42*b*, so as to receive electrical power therefrom. Each of the light emitting diodes can function to generate light in any number of different colors and intensities. Likewise, the physical marking can include various colors which can be imprinted onto the main body so as to be clearly visible when the lighting elements are not illuminated. Of course, the inventive concepts disclosed herein are not limited to the use of LED's, as any number of other known elements capable of producing light can also be utilized.

As described herein, the term address information 45 can be used to describe any number and type of distinctive elements such as various markings, letters, numbers, words, shapes, symbols, logos, designs, and/or patterns, for example. In the preferred embodiment, the address information can be arranged to display the physical address of the home or building to which the mailbox is located; however, other embodiments are contemplated wherein the address information can include or comprise other information such as a sports team logo, a slogan, and/or the family name of the residence (see FIG. 6), for example.

In the preferred embodiment, each of the address indicators 40 can include a height (i.e., distance between the top and bottom ends) that is complementary to the distance between the upper and lower channels 31*a* and 31*b*, respectively of the receiver unit 30. Such a feature allows any number of individual address indicators to be slid along the main body 31 and held in place by the channels. When so positioned, receiver contacts 42*a* and 42*b* will be in communication with supply contacts 35*a* and 35*b*, respectively, so as to provide power to illuminate the lighted elements 43.

Figure 5:
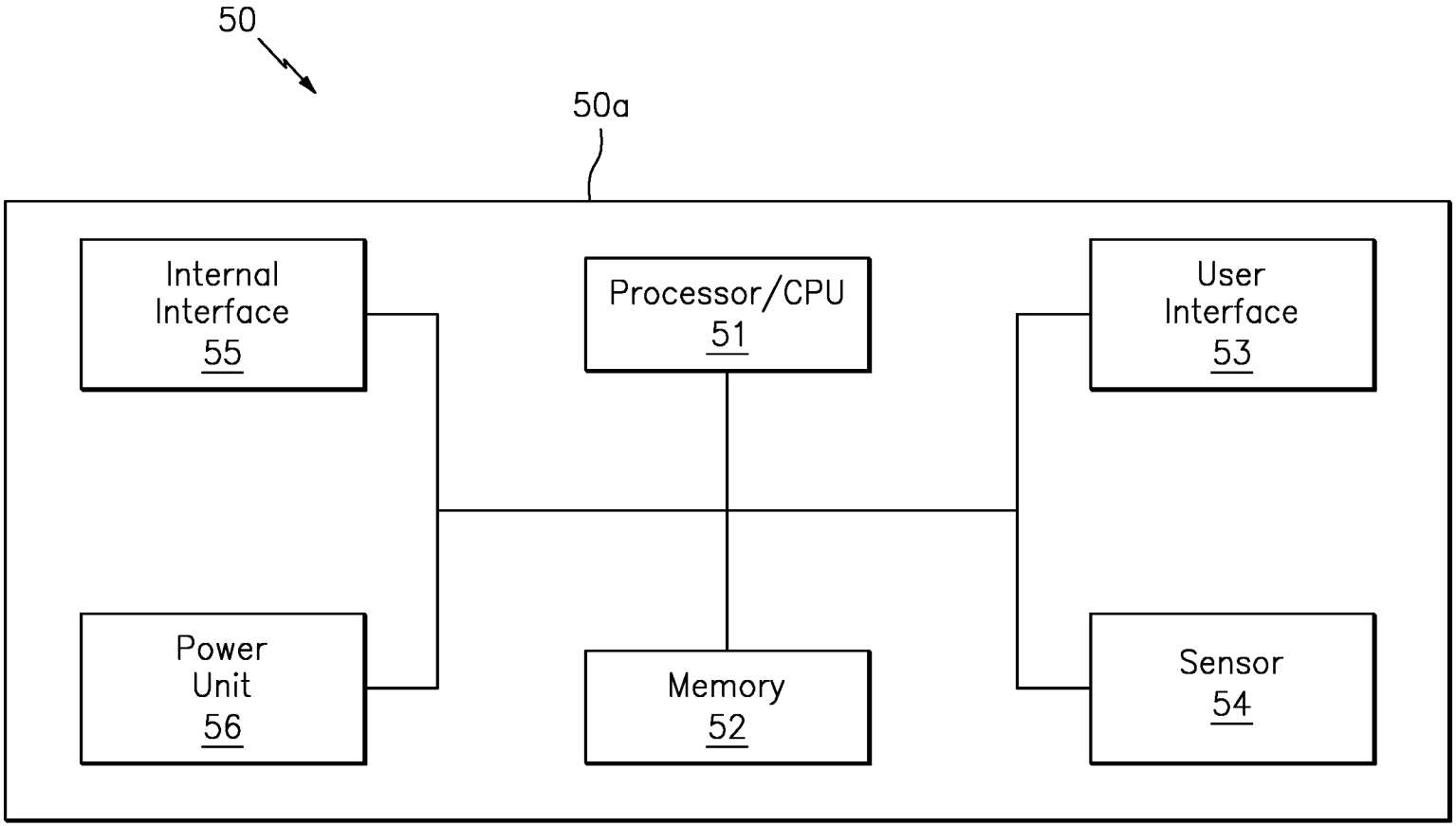
FIG. 5 is a simplified block diagram of the internal controller of the mailbox system, in accordance with one embodiment of the invention.

FIG. 5 is an exemplary block diagram of an internal system controller 50 which may be used with the system 10. As shown, the internal controller 50 can include any number of different components which can function to perform the methodology described herein. In various embodiments, the system controller can include an outer shell/body 50*a* having a processor 51 that is conventionally connected to an internal memory 52, a user interface 53, a sensor 54, an internal component interface unit 55, and/or a power unit 56.

Although illustrated as separate elements, those of skill in the art will recognize that one or more system components may comprise, or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The main body 50*a* can include any number of different shapes and sizes, and can be constructed from any number of different materials suitable for encompassing each of the controller elements. In one preferred embodiment, the main body 50*a* can be constructed from lightweight injection molded plastic having a plurality of internal connectors (not shown) for securely housing each of the device elements. The controller body can be secured anywhere within or along the mailbox body, and preferably within the recessed area 22*a*, for example.

The processor/CPU 51 can act to execute program code stored in the memory 52 in order to allow the device to perform the functionality described herein.

Memory 52 can act to store operating instructions in the form of program code for the processor 51 to execute. As such, memory 52 can include one or more physical memory devices such as, for example, local memory and/or one or more bulk storage devices which can provide storage of at least some program code in order to operate the system as described herein.

The user interface 53 can function to accept user inputs to the system controller. In various embodiments, the user interface can include or control one or more buttons/switches 53*a*, that are connected to the processor 51 so as to activate various programmatic functions, such as selectively activating the lighting elements of the address indicators 40 and/or transitioning the system between an ON and OFF operating state, for example.

The system can also include one or more sensors 54, such as a commercially available dusk to dawn photosensor, for example. Such a sensor can be used to allow the lighted elements to remain illuminated at night, and to remain in the OFF operating state during daylight hours, thus preserving battery power and prolonging the lifespan of the system.

The internal component interface unit 55 can function to provide a communicative link between the processor 51 and various other device components such as the receiver unit 30, the address indicator 40, and/or the sensor 54, for example. In this regard, the component interface unit can include any number of different components such as one or more PIC microcontrollers, internal bus, USB connections and other such hardware capable of providing a direct link between the various components. Of course any other means for providing the two way communication between the system components can also be utilized herein.

Figure 6:
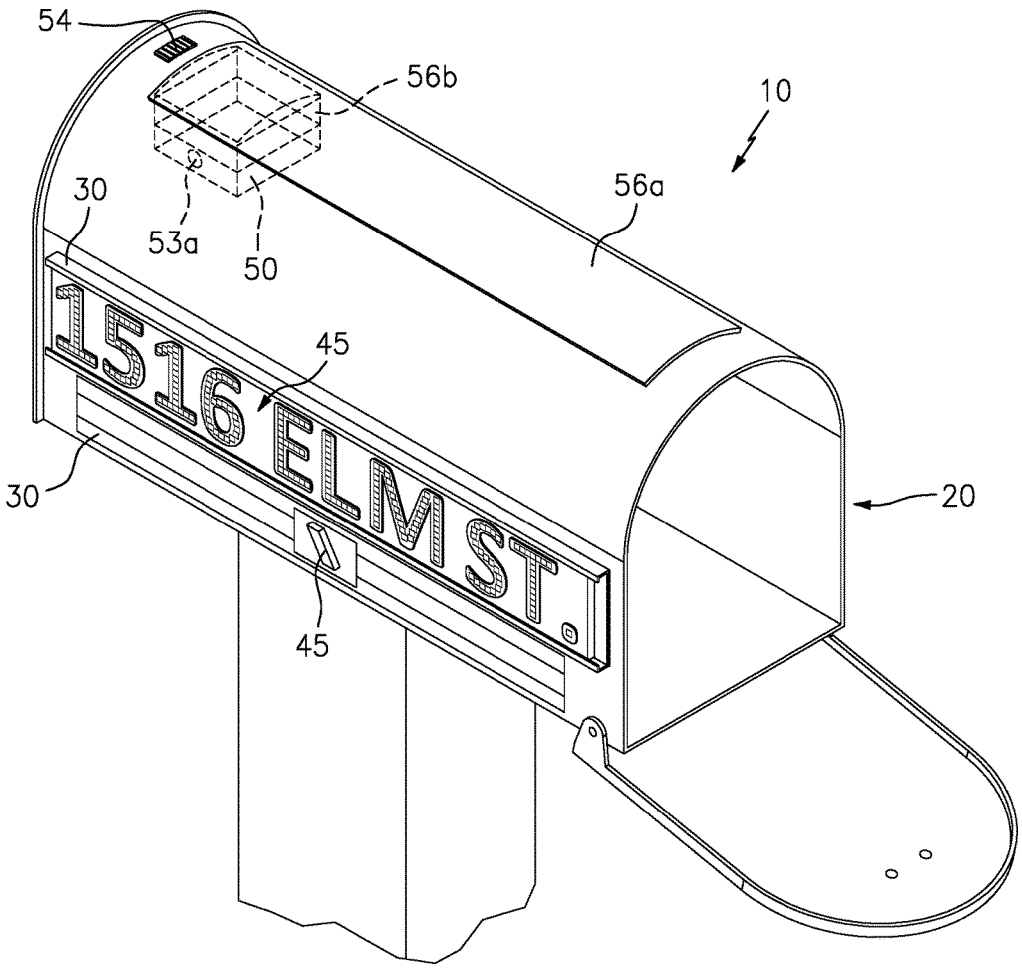
FIG. 6 is a perspective view of the mailbox system in operation, in accordance with one embodiment of the invention.

The power unit 56 can function to provide the necessary power requirements to the system components. In the preferred embodiment, the power unit can include one or more photovoltaic cells (i.e., solar cell) 56*a* that are connected to one or more batteries 56*b*. As shown in FIG. 6, the battery 56*b* and controller 50 can preferably be positioned within the recessed area of the mailbox, and the solar cell 56*a* can be positioned above the same. As such, the location of the solar cell (along with the body of the mailbox body 20) can function to shield the battery and controller against the damaging effects caused by moisture from adverse weather conditions such as rain and snow, for example. Such a location advantageously increases the lifespan of the system components, and allows a user to easily access the battery and/or control unit for easy replacement of the same without having to replace the entire mailbox body.

In operation, a user can position any number of discrete address indicators 40 along each of the receiver units 30 to create any desirable address information. Once the system 10 is positioned outdoors, the mailbox can function in the expected manner to receive and store mail. Likewise, the solar cell 56*b* can convert sunlight into electrical energy which can be stored by the battery 56*b*. Upon receipt of a command from the user interface 53*a* and/or the daylight sensor 54, the system can selectively provide power to the receiver unit, thereby activating each of the lighted elements 43 to illuminate the address information, as described above. Finally, the system can deactivate the lighted elements upon another command from the user interface 53*a* and/or the daylight sensor 54 indicating the presence of sunlight.

Figure 7:
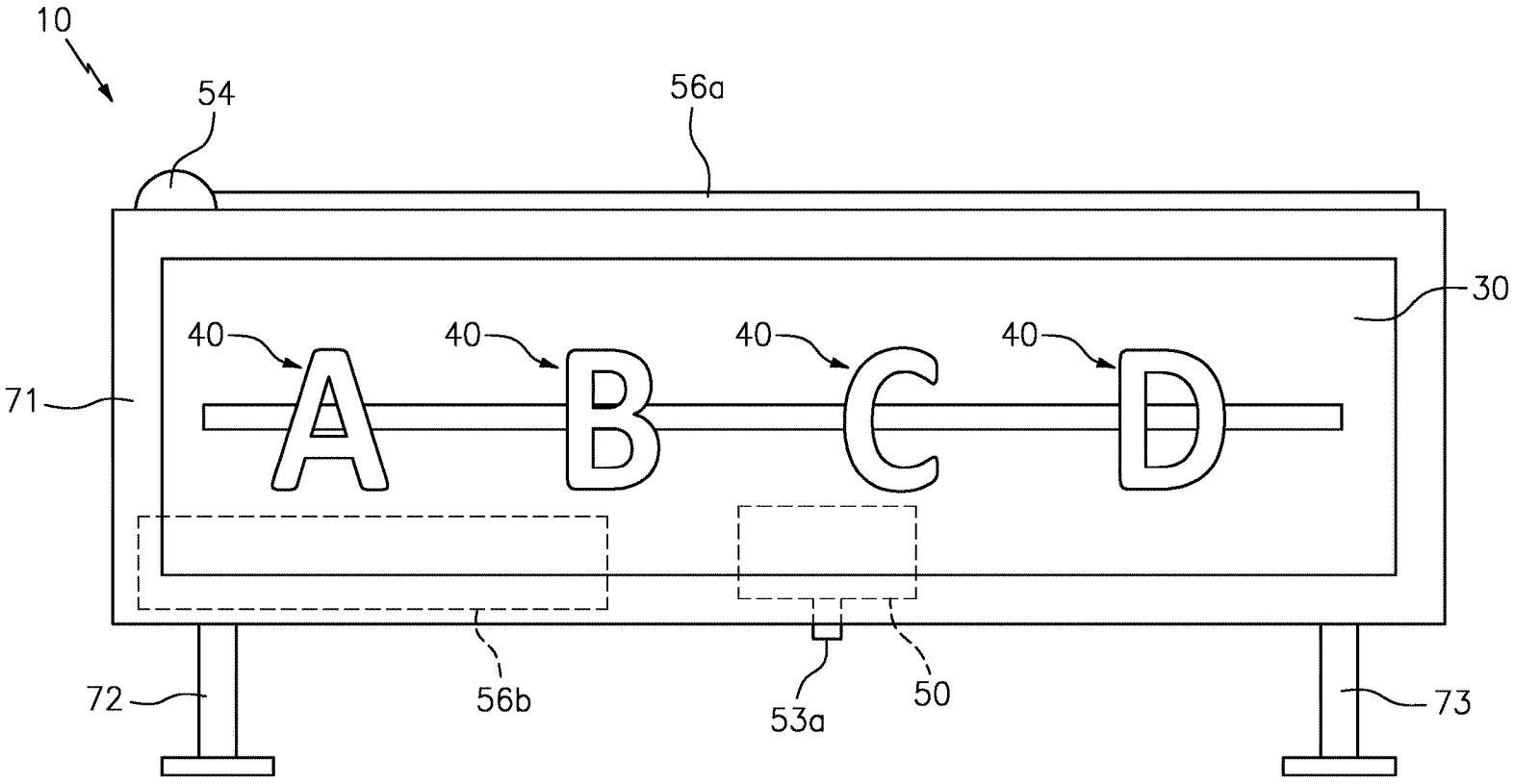
FIG. 7 is a side view of the mailbox system, in accordance with another embodiment of the invention.

Although described above for use with a new mailbox, the inventive concepts are not so limiting. As such, FIG. 7 illustrates another embodiment of the mailbox system that includes a modular design that can be mounted onto an existing mailbox. As shown, the modular system 10 can include a main body 71 having a pair of mounting arms 72 and 73 suspended from a bottom end thereof. The mounting arms can utilize any number of connectors such as screws, nuts and bolts, for example, to be mounted to an existing structure or mailbox. As shown, the controller 50 and battery 56*b* can preferably be positioned within the main body 71, one or more receiver units 30 having any number of address indicators 40 can be mounted along the outside of the main body, and the solar cell 56*a* can be mounted on the top of the main body.

As described herein, the main body 71 can include any number of different shapes and sizes, and can be constructed from any number of different materials. The modular system can function in an identical manner as described above, and can function to incorporate the inventive concepts into existing mailboxes so as to reduce the overall cost of system deployment.

As described herein, one or more elements of the mailbox with illuminated address information 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the receiver unit 30 and the mailbox 20, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A mailbox system, comprising:

a mailbox body having a top wall, a bottom wall, and plurality of sides defining an interior space, an opening disposed along one of the plurality of sides, and a door operably attached for closing the opening;

a receiver unit that is positioned along one of the plurality of sides of the mailbox body;

at least one address indicator that is removably positioned within the receiver unit, said at least one address indicator including a plurality of lighted elements along a front facing surface thereof;

a recessed area that is located along the top wall of the mailbox body; and an internal controller having a power unit for providing power to the receiver unit and the at least one address indicator, said power unit including at least one battery and at least one solar power cell, wherein the internal controller is disposed within the recessed area, and the at least one solar power cell covers both the recessed area and the controller.

2. The mailbox system of claim 1, wherein the receiver unit further includes a pair of elongated channels that are configured to slidingly receive each of the at least one address indicators.

3. The mailbox system of claim 1, wherein the plurality of lighted elements of each of the at least one address indicator comprise light emitting diodes.

4. The mailbox system of claim 3, wherein the plurality of lighted elements of each of the at least one address indicator forms a discrete piece of address information.

5. The mailbox system of claim 4, wherein the address information includes, at least one of a letter, a number, a word and a symbol.

6. The mailbox system of claim 5, further comprising:

a physical marking that encompasses each discrete piece of address information.

7. The mailbox system of claim 6, wherein the plurality of lighted elements are selectively illuminated to display the address information at a night time, and the physical marking includes a color which functions to display the address information during a day time.

8. The mailbox system of claim 1, further comprising:

a pedestal that is in communication with the bottom end of the mailbox body.

9. The mailbox system of claim 1, further comprising:

a daylight sensor that is in communication with the internal controller, and functioning to selectively activate the plurality of lighted elements.

10. The mailbox system of claim 1, further comprising:

a user interface that is configured to receive user instructions, said user interface being in communication with the internal controller and functioning to selectively activate the plurality of lighted elements.

* * * * *